US007819729B2

(12) United States Patent
Rohrer et al.

(10) Patent No.: US 7,819,729 B2
(45) Date of Patent: Oct. 26, 2010

(54) AIR CURTAIN DOORWAY

(75) Inventors: Stephen R. Rohrer, Menomonee Falls, WI (US); Joseph M. Endter, Germantown, WI (US)

(73) Assignee: ASI Technologies, Inc., Milwaukee, WI (US)

( * ) Notice: Subject to any disclaimer, the term of this patent is extended or adjusted under 35 U.S.C. 154(b) by 1015 days.

(21) Appl. No.: 11/070,488

(22) Filed: Mar. 2, 2005

(65) Prior Publication Data

US 2005/0197057 A1 Sep. 8, 2005

Related U.S. Application Data

(60) Provisional application No. 60/549,258, filed on Mar. 2, 2004.

(51) Int. Cl.
*F24F 9/00* (2006.01)

(52) U.S. Cl. ..... 454/191

(58) Field of Classification Search ..... 454/191
See application file for complete search history.

(56) References Cited

U.S. PATENT DOCUMENTS

| | | | | |
|---|---|---|---|---|
| 1,915,704 A | | 6/1933 | Warren | |
| 2,558,997 A | | 7/1951 | Voelker | 62/89 |
| 2,706,387 A | | 4/1955 | Swanson | 62/117.4 |
| 2,827,266 A | | 3/1958 | Ruff | 257/9 |
| 3,023,688 A | | 3/1962 | Kramer, Jr. | 98/36 |
| 3,025,681 A | | 3/1962 | Booth | 62/248 |
| 3,190,207 A | * | 6/1965 | Weisz | 454/191 |
| 3,206,187 A | | 9/1965 | Cagley | 268/64 |
| 3,218,952 A | | 11/1965 | Gygax | 98/36 |
| 3,326,012 A | | 6/1967 | Asker et al. | 62/78 |
| 3,462,966 A | | 8/1969 | Reid et al. | 62/248 |
| 3,687,053 A | | 8/1972 | Henson et al. | 98/33 |

(Continued)

FOREIGN PATENT DOCUMENTS

WO WO 2004/079281 9/2004

OTHER PUBLICATIONS

Applicant's Exhibit A, "flexalre barrier", four-page brochure of Flexon, Leetsdale, PA, 1997, admitted prior art.

(Continued)

*Primary Examiner*—Steven McAllister
(74) *Attorney, Agent, or Firm*—Quarles & Brady LLP

(57) ABSTRACT

An air curtain doorway for preventing cross-filtration of air at a doorway between a relatively warm area and a relatively cool area has duct work and an air mover. The duct work includes a supply air duct and a return air duct at opposite sides of the doorway joined by an intermediate air duct at the top of the doorway. The intermediate air duct houses the air mover, which creates an air stream circulated through the duct work that blows an air curtain from the supply air duct to the return air duct. The return air duct has an enlarged collector chamber upstream of an adjustable return air inlet aperture into which the downstream end of the air curtain is drawn. The supply air outlet aperture is at the base of a nozzle that has an upper portion that directs the air curtain toward the warm side and a lower portion that directs the air curtain toward the cold side of the doorway.

15 Claims, 7 Drawing Sheets

U.S. PATENT DOCUMENTS

| | | | | | |
|---|---|---|---|---|---|
| 3,817,160 | A | | 6/1974 | Searcy et al. | 98/36 |
| 3,859,900 | A | | 1/1975 | Fordsmand | 98/36 |
| 3,998,142 | A | | 12/1976 | Foreman et al. | 98/36 |
| 4,009,586 | A | | 3/1977 | Skvarenina | 62/80 |
| 4,074,620 | A | | 2/1978 | Jansson | 98/36 |
| 4,109,484 | A | | 8/1978 | Cunningham | 62/256 |
| 4,427,049 | A | | 1/1984 | Belanger et al. | 160/199 |
| 4,432,406 | A | | 2/1984 | Belanger et al. | 160/199 |
| 4,516,482 | A | | 5/1985 | Smith | 98/36 |
| 4,666,477 | A | * | 5/1987 | Lough | 96/381 |
| 4,855,567 | A | | 8/1989 | Mueller | 219/218 |
| 4,950,869 | A | | 8/1990 | Mueller | 219/218 |
| 5,203,175 | A | | 4/1993 | Farrey et al. | 62/82 |
| 5,329,781 | A | | 7/1994 | Farrey et al. | 62/82 |
| 5,339,643 | A | | 8/1994 | Pikaart | 62/80 |
| 6,058,722 | A | | 5/2000 | Choi | 62/256 |
| 6,106,387 | A | | 8/2000 | Smith | 454/190 |

OTHER PUBLICATIONS

Applicant's Exhibit B, "Conditioned Air Curtain", four-page brochure of HCR, Inc., Falls Church, VA, undated, admitted prior art.

Applicant's Exhibit C, "Frost-Free Airlok-Door".sixteen-page instruction manual of HCR, Inc., Lewistown, MT, undated, admitted prior art.

Applicant's Exhibit D, "Frost-Free Freezer Doorways", forty-page product bulletin of HCR, Inc., Lewistown, MT, undated, admitted prior art.

Applicant's Exhibit E, "Model DCAV Conditioned Air Vestibules", twenty-four page instruction booklet of HCR, Inc., undated, Falls Church, VA, admitted prior art.

Applicant's Exhibit F, "The Problems of Frost, Fog, and Ice in Freezers: Part 1—The Cause", five-page operations bulletin of HCR, Inc., Falls Church, VA, Aug. 1993, admitted prior art.

Applicant's Exhibit G, "The Problems of Frost, Fog, and Ice in Freezers: Part 2—The Solution", five-page operations bulletin of HCR, Inc., Falls Church, VA, Sep. 1983, admitted prior art.

* cited by examiner

AIR CURTAIN DOORWAY

CROSS-REFERENCE TO RELATED APPLICATION

This claims the benefit of U.S. Provisional Patent Application No. 60/549,258 filed Mar. 2, 2004.

STATEMENT CONCERNING FEDERALLY SPONSORED RESEARCH OR DEVELOPMENT

Not applicable.

FIELD OF THE INVENTION

This invention relates to an air infiltration barrier at a doorway, and more particularly, to an improved air curtain doorway for preventing cross-filtration of relatively cool and warm air masses at the opening of a refrigerated space.

BACKGROUND OF THE INVENTION

Refrigerated storage or warehouse facilities are commonly used within the food industry to prevent bacteria and prolong the life of perishable foods. To reduce energy costs, these refrigerated warehouses typically have one or more cold storage rooms adjacent to rooms at more moderate temperatures. Doorways allow access between these rooms by forklifts and personnel. At open doorways between cool and warm areas, some of the higher pressure, but lighter, warm moist air will flow into the cool area primarily from the top of the doorway (warm air infiltration) in exchange for heavier cool air at the bottom of the doorway (cold air exfiltration). Such air flow has maximum and opposite forces at the top and bottom of the doorway which diminish to zero near the midpoint of the doorway.

Depending upon the conditions of the two air masses, this cold air exfiltration and warm air infiltration can cause numerous problems. Infiltrating humid warm air tends to become supersaturated within the cold room, which leads to precipitation or airborne ice crystals at the doorway. The infiltrating humid warm air also leads to ice build-up within the cold room, especially on the floor, doors, walls and/or products adjacent to the doorway. Ice can also build up within refrigeration coils causing damage to the refrigeration unit. Additionally, the warm air infiltration inflates energy costs for refrigerating the cold rooms. Conversely, the exfiltrating cool air tends to mix with the humid warm air to cause fog at the warmer side of the doorway. The fog reduces visibility and can lead to wet slippery floors at the doorway.

There have been many attempts in the prior art to reduce or eliminate the adverse effects of the colliding cool and warm air masses at the doorways of cold storage rooms. One common approach is to use a physical barrier at the doorway, including ordinary hinged doors having overlapping edges or sweeps that reduce the air flow through the gaps around the door panels. Hinged doors hamper the ingress and egress through the doorway, and the sealed edges have been found problematic because during periods of non-use ice tends to form on the seal and the floor or door jamb freezing the doorway closed. Another type of physical barrier is the well-known strip door often having transparent plastic or vinyl strips depending from the doorway header. Strip doors are typically low-cost and improve passage through the doorway, but the strips can separate with use allowing cross-filtration of the air. Once this begins to occur, the strips can become coated with ice so as to reduce visibility through the doorway and potentially join the strips together. Also, strips doors are typically unsuitable for storage of items requiring sanitary conditions, such as cold food storage, since the strips may come in contact with the items when passing through the doorway.

Another solution to this problem has been achieved with the use of what is commonly referred to as an "air curtain". An air curtain eliminates physical barriers at the doorway and facilitates unobstructed passage through the doorway. An air curtain is formed by an apparatus having an air mover producing a relatively high velocity air stream across the doorway, either from side to side or top to bottom, to counteract the forces of the infiltrating air masses. The air curtain apparatus may also contain a heater to condition the air stream flowing through it and reduce or prevent fogging or precipitation at the doorway, which may otherwise have occurred as the air stream mixes with the warm and cool air masses while passing across the doorway.

A problem that must be addressed by an air curtain doorway is mixing of the air that is intended to form the curtain with the warm side air and with the cold side air. The width of these doorways can be considerable, for example ten feet or more, and ideally all of the air that is blown out of the supply side of the doorway, and no other air, is sucked into the return side of the doorway for recirculation through the doorway. Sucking in the warm moist air can result in the formation of ice, which requires running the heaters to keep ice from forming, and sucking in the cold air also forms ice, which requires running the heaters, and creates an additional load for the refrigerated room refrigeration system. Running the heaters, of course, results in energy inefficiency and increased costs.

The typical solutions in the prior art have been to increase the volume of air flow across the doorway, run multiple airflows, or simply run the heaters more. The present invention addresses this problem to minimize the mixing of warm side and cold side air with the air curtain stream.

SUMMARY OF THE INVENTION

The present invention addresses these problems by producing an air curtain which exits a relatively thin outlet aperture at the supply and is collected in a collector chamber at the return prior to entering restrictions that are downstream of the collector chamber.

In particular, the present invention is an air curtain doorway for forming an air curtain across a doorway between a relatively low temperature area and a relatively high temperature area. The doorway includes duct work having a supply air duct, a return air duct and an intermediate air duct. The supply air duct is located at a first side of the doorway and has an outlet aperture extending substantially the height of the first side. The return air duct is located at the second, opposite side of the doorway and has an inlet aperture extending substantially the height of the second side. The intermediate air duct joins the supply and return air ducts. An air mover draws an air stream through the duct work into the inlet aperture to the return air duct, through the intermediate air duct to the supply air duct, and out the outlet aperture. One or more nozzles can be provided to extend along substantially the entire outlet aperture of the supply air duct and direct the air stream toward the return air duct.

In another aspect, the return air is metered at the return air duct, by making the return air aperture from the collector chamber to the return air stream adjustable in area.

The foregoing and other objects and advantages of the invention will appear from the following description. In the description, reference is made to the accompanying drawings which form a part hereof and in which there is shown by way of illustration a preferred embodiment of the invention. Such embodiment does not necessarily represent the full scope of the invention, however, and reference must be made therefore to the claims for interpreting the scope of the invention.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
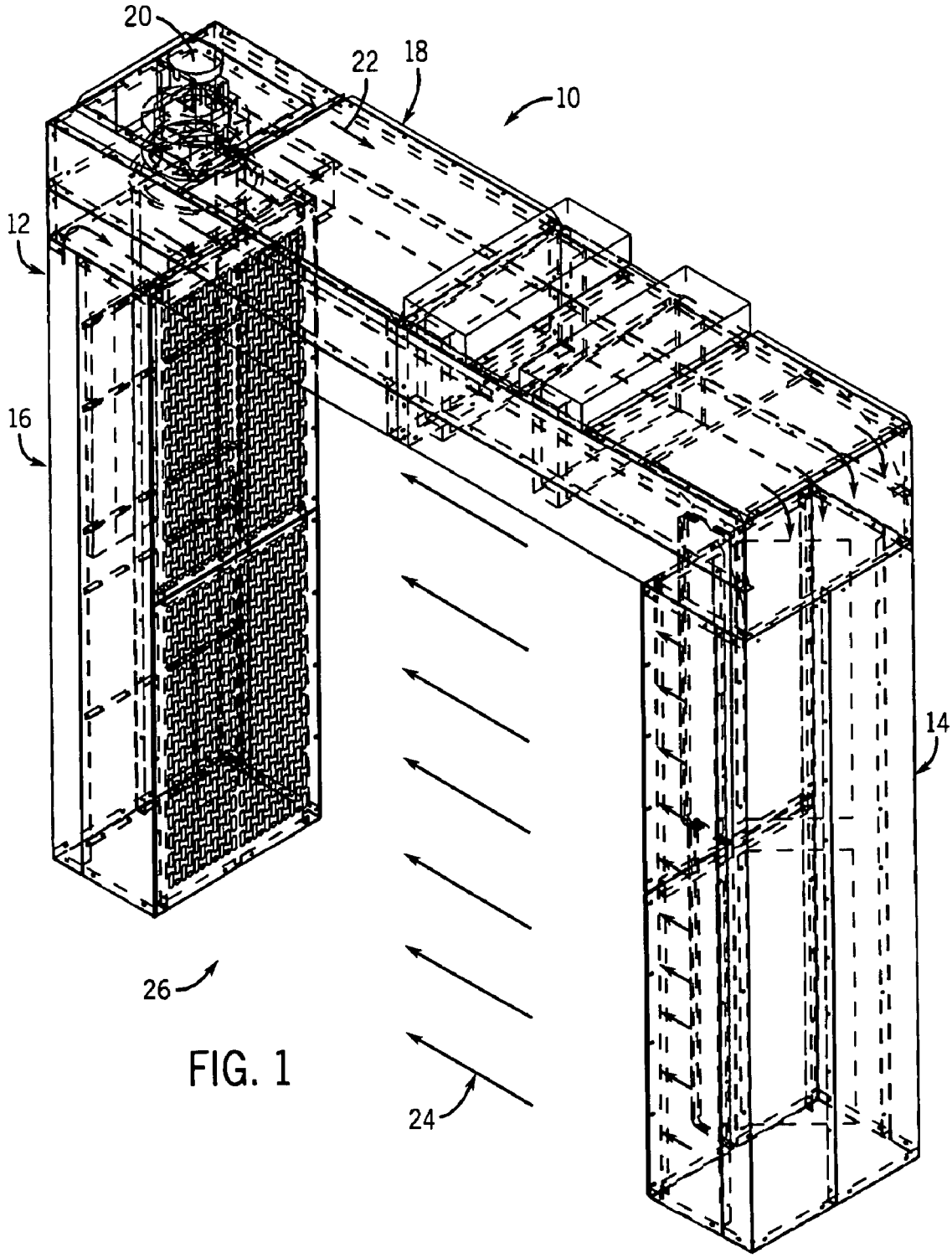
FIG. 1 is a perspective view of an air curtain doorway of the present invention.

Referring to FIG. 1, an air curtain doorway assembly incorporating the present invention is generally designated by reference numeral 10 in FIG. 1. The doorway 10 comprises sheet metal-duct-work including a supply air duct 14, return air duct 16 and an intermediate air duct 18, also referred to as header 18. An air mover 20 is disposed within the duct-work 12, preferably at the return air side of the header 18, to circulate an air stream 22 through the duct-work and create an air curtain 24 across doorway opening 26, between the ducts 14 and 16 and below the duct 18.

The doorway assembly 10 is placed with the bottoms of the ducts 14 and 16 resting on the floor around the doorway opening 26 and is secured to the doorway jamb structure (not shown) of the building in which the doorway 10 is installed and/or to the floor by suitable fasteners (not shown). The doorway assembly 10 is positioned such that the air supply duct 14 is along one side and the air return duct 16 is along the opposite side of the doorway opening 26, which is preferably about the same size as the doorway opening of the building's jamb structure. The header is positioned along the top of the doorway opening 26, preferably with the bottom of the header 18 about at the same height as the top of the doorway opening of the jamb structure of the building or slightly higher, and joins the supply 14 and return 16 air ducts by suitable fasteners such as sheet metal screws, rivets, welding, fold joints or other suitable means. In FIG. 1, the supply air duct 14 is shown on the right side of the opening 26 with the air curtain 24 flowing from right to left. However, the present invention is not limited in this regard, as the supply 14 and return 16 air ducts may be on alternate sides of the doorway 26. Also, the doorway assembly 10 is preferably on the relatively cold air side of the jamb structure of the doorway in which it is installed, but it may alternatively be mounted in the warm side.

The air ducts 14, 16, 18 are preferably constructed of a standard grade duct work sheet metal as is known in the art, however, any suitable material may be used. The air ducts 14, 16, 18 form a three-sided open upside down U-shaped structure. In this embodiment, each of the ducts 14, 16, 18 is approximately 24×40 inches in width and depth dimensions. The height of the supply and return ducts 14, 16 is preferably equal to the height of the doorway opening of the doorway in which the assembly 10 is installed, plus approximately six inches. This would be the height of the ducts 14 and 16, and the duct 18 is positioned on top of them, for example 10 feet may be a typical height to the bottom of the duct 18 if the doorway of the building is 9 feet 6 inches tall. Each air duct has opposed front and rear faces, and opposed inside and outside faces.

Figure 3:
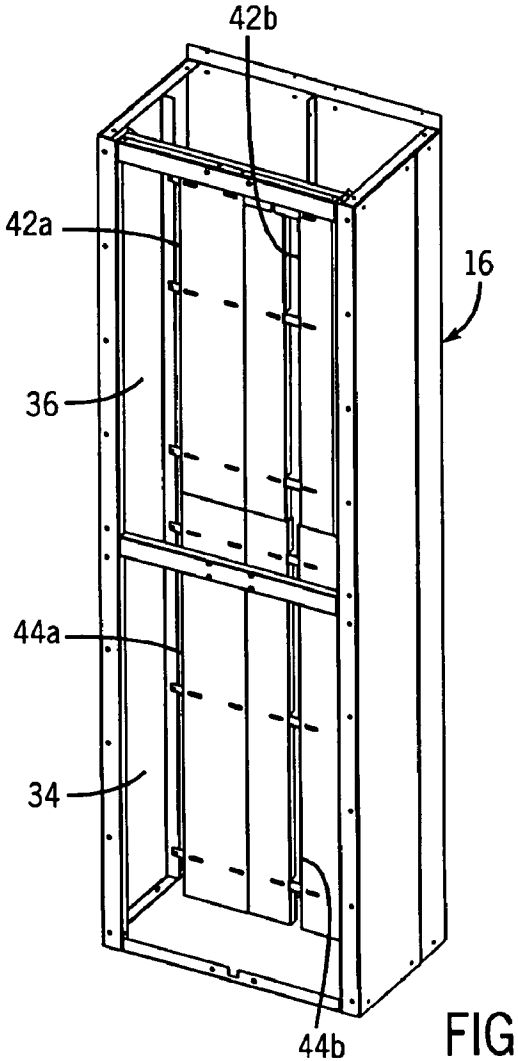
FIG. 3 is a perspective view of the return air duct with the intake grate removed.
Figure 2:
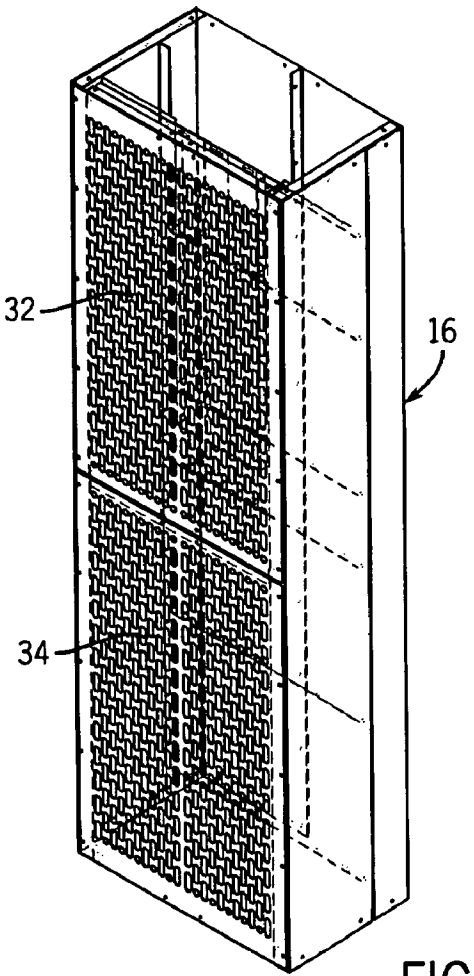
FIG. 2 is a perspective view of the return air duct of the doorway of FIG. 1 with an intake grate installed.
Figure 6A:
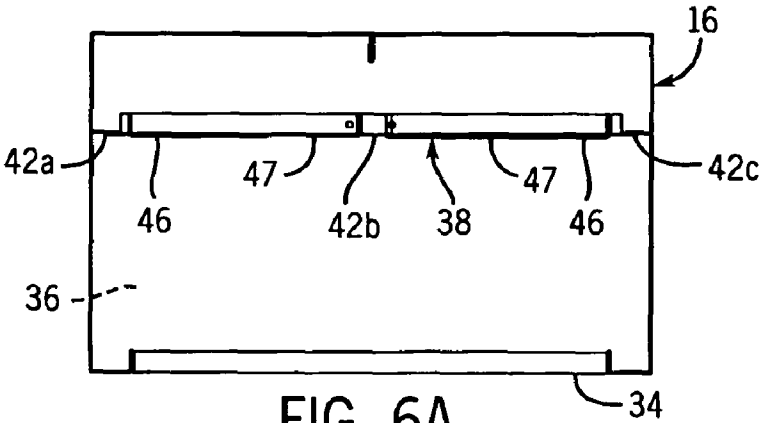
FIG. 6A is a section view from the plane of the line 6-6 of FIG. 4, with the intake grate removed.
Figure 6B:
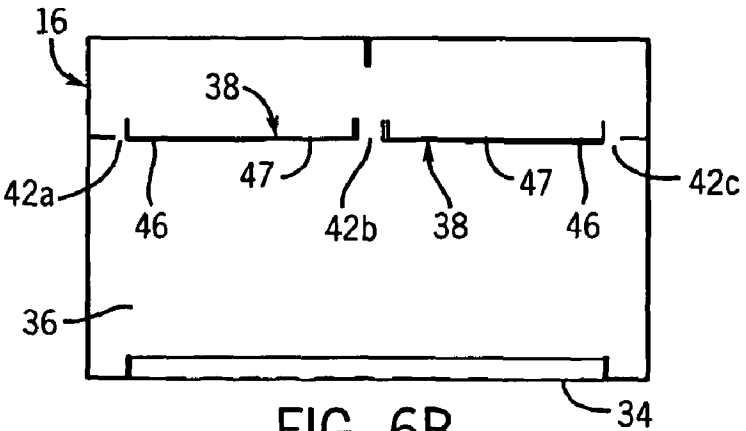
FIG. 6B is a section view like FIG. 6A but with the cross-brace removed to more clearly illustrate the return air apertures.
Figure 5:
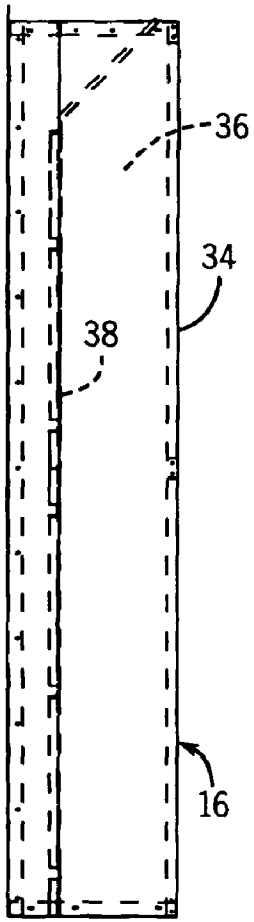
FIG. 5 is a side elevation view of the return air duct with the intake grate removed.
Figure 4:
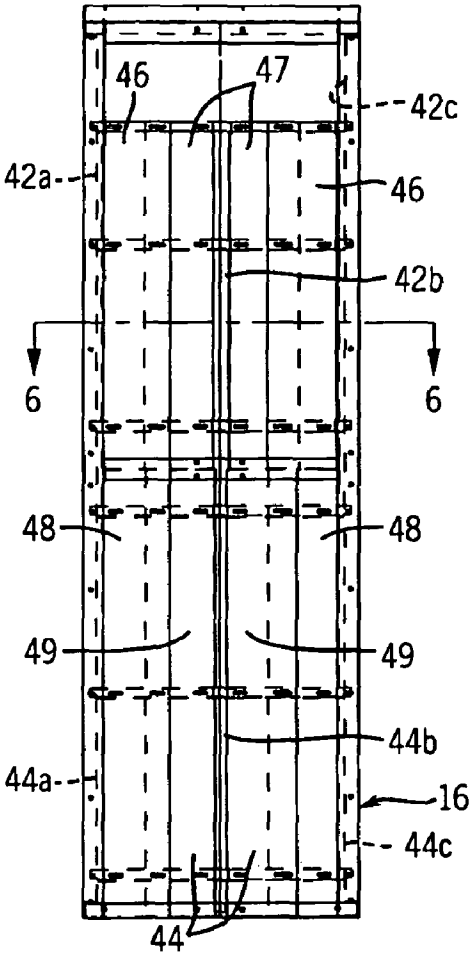
FIG. 4 is a front elevation view of the return air duct with the intake grate removed.
Figure 7:
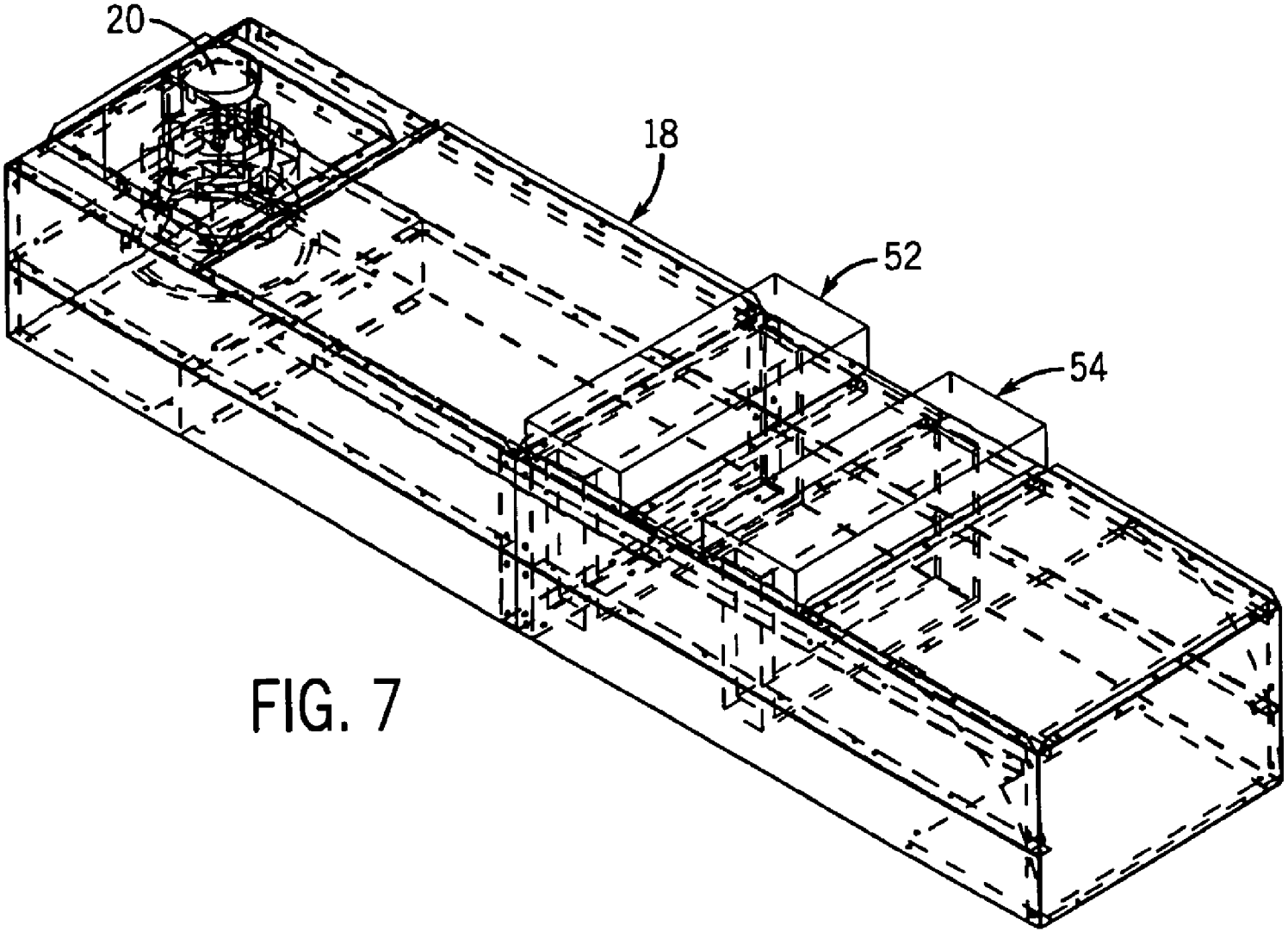
FIG. 7 is a perspective view of the header for the doorway.
Figure 9:
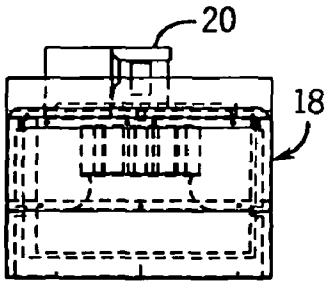
FIG. 9 is an end elevation view of the header.
Figure 11:
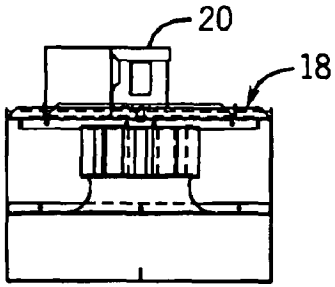
FIG. 11 is a section view from the plane of the line 11-11 of FIG. 8.

Referring to FIG. 2, the return air duct 16 may be provided with an optional grate 32. The grate 32 is perforated with many holes, so many that the performance of the return air duct 16 is virtually unchanged whether the grate 32 is installed or not. The grate 32 does not provide any appreciable restriction to the flow of air into the intake opening 34, which is in the plane of the grate 32, of the return air duct 16. As used herein, the intake opening 34 refers to the plane of the inside surface or face of the duct 16, indicated as 34 in FIGS. 2 and 3. Directly downstream from the intake 34 is a collector chamber 36, referring to FIGS. 3-6.

Downstream of the collector chamber 36, which is open at its upstream end face and closed at its side faces by the side walls of the duct 16, is a wall 38 that extends from top to bottom of the duct 16 and has apertures 42*a*, 42*b* and 42*c* (a is left aperture, b is center aperture and c is the right aperture) in the upper portion and apertures 44*a*, 44*b* and 44*c* in the lower portion, that are adjustable in width. Together, the apertures 42*a-c* define an upper return air aperture portion of a certain total width (for example, if the left and right apertures 42*a*, 42*c* are a maximum of 2 inches in width and the center aperture 42*b* is a maximum of 4 inches in width, then the total aperture width is 8 inches), and the apertures 44*a-c* define a lower return air inlet aperture portion of a certain total width (the maximum width of the lower apertures can be the same as for the upper apertures 42*a-c*), the upper and lower aperture portions combined creating a return air aperture that is substantially equal in height to the height of the air curtain. Wall 38 has overlapping plates 46 and 47 on the top and similar overlapping plates 48 and 49 on the bottom portion that define the respective slots 42*a-c* and 44*a-c* and are mounted to the wall 38 by fasteners that extend through horizontally oriented slots in the ends of the plates 46, 47, 48 and 49. Thereby, the plates can be slid horizontally to set the width of the respective slots 42*a-c* and 44*a-c*. This is desirable so as to adjust the amount of suction at the return end of the air curtain and also to balance the return duct from top to bottom, as it has been found desirable to have smaller apertures, in other words of a reduced width, on the upper portion than on the lower portion, as can be achieved by adjusting the upper return air apertures 42*a-c* to be less in total width than the lower return air apertures 44*a-c*.

At the top of the duct 16, the wall 38 is inclined inwardly so as to provide a transition to the inlet of the air mover 20, that is larger than the dimensions of the duct behind the wall 38. The air mover 20 is preferably provided at the return duct side of the header 18 rather than at the supply air side of the header 18. In other words, it is preferred to push the air stream through the header 18 rather than to pull it. This helps in the operation of the heaters 52 and 54, also provided in the header 18, and also helps to provide a more significant volume in the plenum that provides a static pressure upstream of the supply air outlet aperture, which aids in providing a more constant air flow out of the outlet aperture of the duct 14. Preferably, one or the other of the heaters 52 and 54 is provided with a pressure sensor, for example a pitot tube type pressure sensor, that only allows the heater to turn on if the sensor senses an air flow past the heater. Such a sensor is typically downstream of the heater and is usually preferable for electric heaters. The heaters 52 and 54 may each be, for example 36 kilowatts. However, other types of heaters such as a heat exchanger having an external source of heat (e.g., gas or reclaimed heat from an air conditioning process) could also be used. The heaters are provided to raise the temperature of the air stream so as to avoid the formation of ice. It is desirable to run the heaters as little as possible to conserve energy, but they must be operated enough to avoid the formation of ice. Preferably, the heat can be selectively metered to match the heat input needed, for example using an SCR to regulate the heaters if they are electric or using a metering valve to regulate the heaters if they are heated by gas heat.

Preferably, the air mover 20 is a fan that is capable of generating a relatively significant static pressure, for example a static pressure of at least 1 inch of water upstream of the air mover in steady state flow conditions. In the preferred embodiment, a plug fan is used that is capable of creating a static pressure of 2.8 inches of water at 3350 cfm, that is commercially available from Cincinnati Fan of Mason, Ohio as the CPF-180 Direct Drive Fan, or if more resistance is created by, for example, a gas heating coil, the CPF-200 creates a static pressure of 2.8 inches of water at 3910 cfm. The air mover 20 sucks air up through the return air duct 16, that enters the rear part of the duct 16 behind the wall 38 through the apertures 42 and 44, and the air mover 20 pressurizes the header 18 downstream of the mover 20 and also pressurizes the supply air duct 14.

Figure 8:
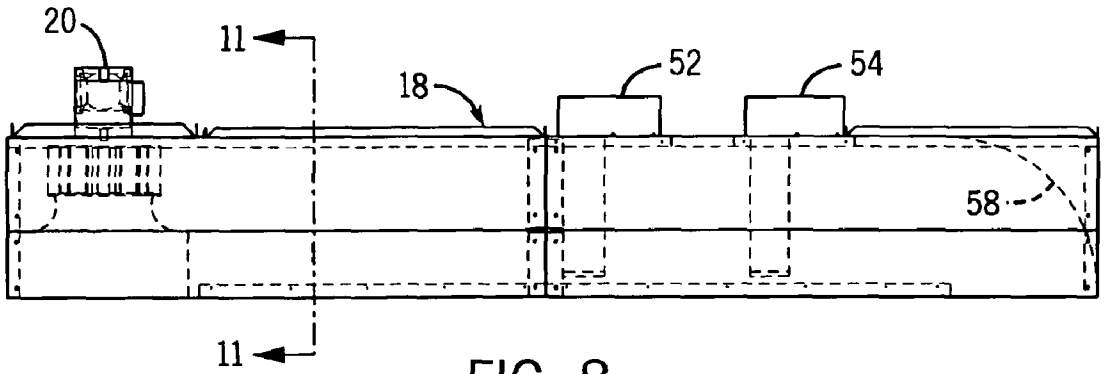
FIG. 8 is a front elevation view of the header.
Figure 10:
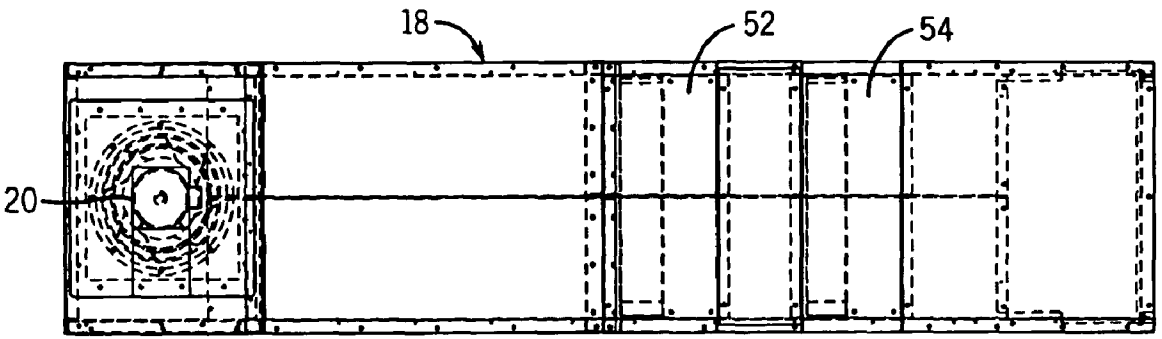
FIG. 10 is a top elevation view of the header.

At the outlet end of the header 18, downstream from the air mover 20 and downstream from the heaters 52 and 54, the supply duct 14 extends downwardly from the header 18 to the floor. At the supply end of the header 18, the lower or inside face of the header 18 is completely open to permit air to flow downwardly from the header 18 into the supply duct 14. In the supply duct 14, the air is turned from a generally vertically downward flow direction to a generally horizontal flow direction, toward the return duct 16. As mentioned above, the flow produced by the air mover 20 is such that it creates a static pressure inside the supply duct 14. As best shown in FIG. 8, the duct 18 may also be provided with a curved corner panel 58 to help turn the air stream 22 downwardly from the header 18 to the supply duct 14.

Referring to FIGS. 12-15, the supply air duct 14 is open on the inside and at its inside face a nozzle having an upper portion 64 and a lower portion 66 is provided. The inlet end or base of the nozzle defines a supply air outlet aperture that may be, for example, about 12 to 1 inches in width. From the outlet aperture, spaced panels of each respective nozzle portion 64 and 66 extend inwardly, i.e. toward the return air duct 16, and are spaced apart so as to be parallel with one another and spaced apart by the ½" to 1" dimension of the supply air outlet aperture. This creates a laminar flow exiting the nozzle portions 64 and 66, of a relatively high velocity, since there is a static pressure in the side duct 14 of a significant magnitude.

Figure 14:
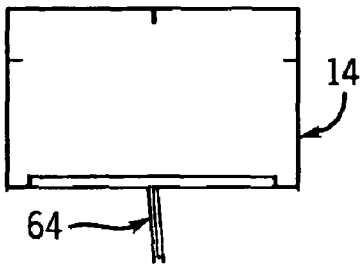
FIG. 14 is a section view from the plane of the line 14-14 of FIG. 13.
Figure 15:
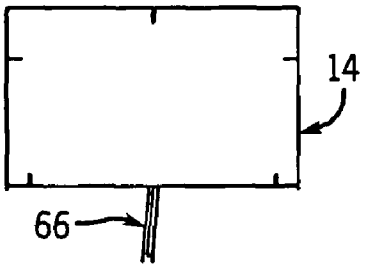
FIG. 15 is a section view from the plane of the line 15-15 of FIG. 13.
Figure 13:
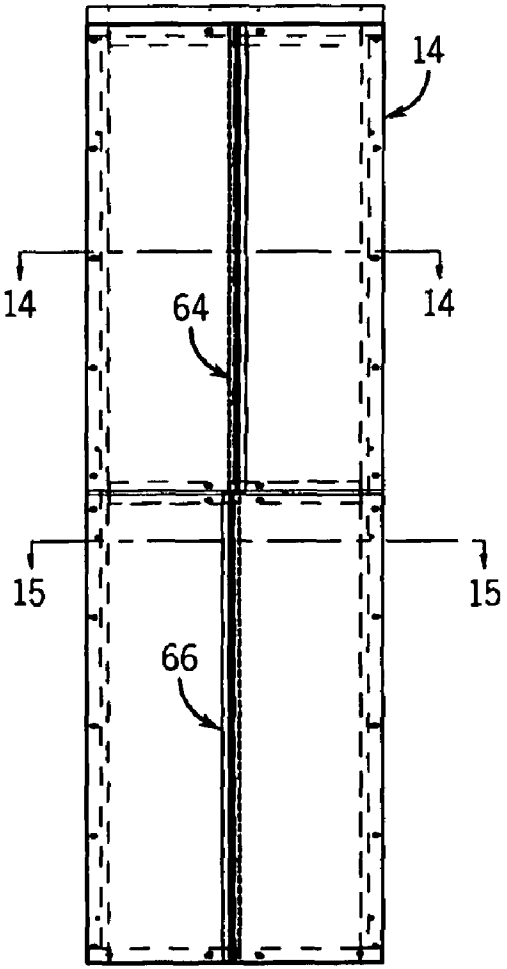
FIG. 13 is a front elevation view of the supply air duct.
Figure 12:
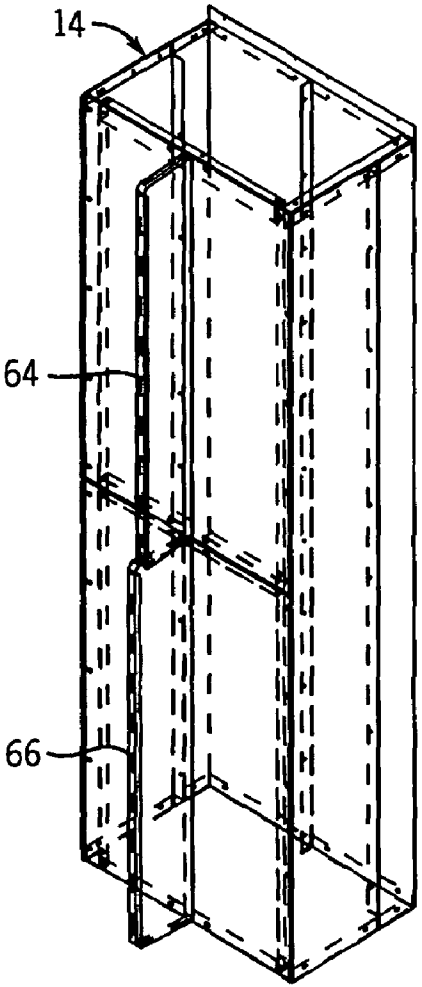
FIG. 12 is a perspective view of the supply air duct of the doorway.

Preferably, as illustrated in FIGS. 14 and 15, the nozzle portion 64 directs the upper portion of the air stream 24 toward one side of the doorway 10, and the nozzle portion 66 directs the lower portion of the air stream 24 toward the other side of the doorway 10. Preferably, the upper portion 64 directs the air curtain toward the warm side and the nozzle portion 66 directs the air curtain 24 toward the cold side, since warm air tends to go through the doorway 10 at the top and cold air tends to go through the doorway 10 at the bottom. Preferably, the spacing between the plates that make up each nozzle portion 64 and 66 is also adjustable, for example by having one of the walls that makes up the sides of the nozzle portions be provided with a flange with horizontal slots so that the one portion of each nozzle can be slid horizontally so as to vary the spacing between the walls of each nozzle portion.

Figure 17:
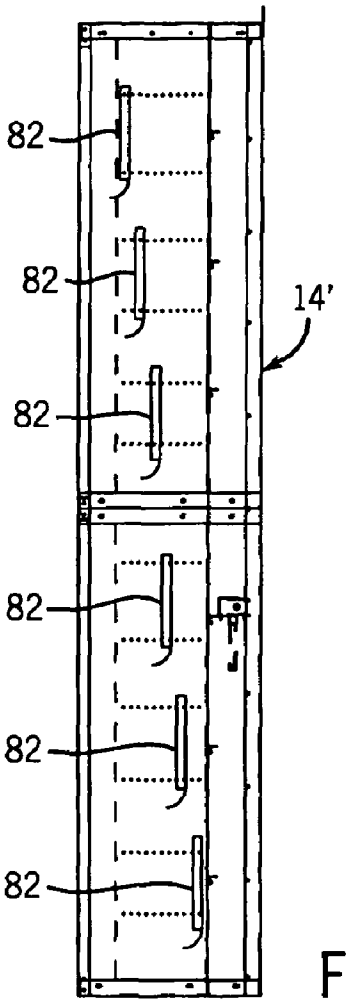
FIG. 17 is a side sectional view from the plane of the line 17-17 illustrating turning vanes installed in the supply air duct of FIG. 16.
Figure 16:
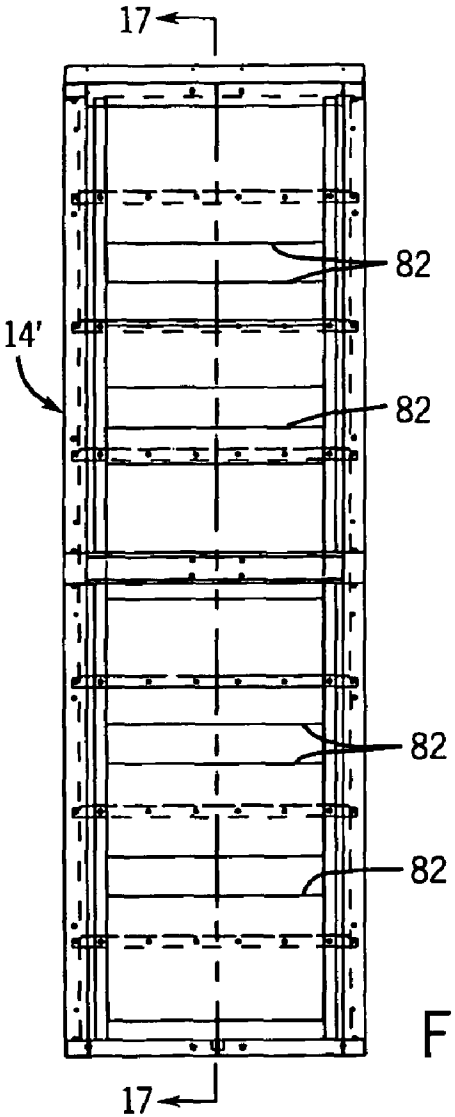
FIG. 16 is a front plan view of an alternate embodiment of a supply air duct with the front cover and nozzles removed.

FIGS. 16 and 17 illustrate an alternate embodiment of the supply air duct 14' illustrated without the inside face cover or the nozzles 64, 66. The duct 14' differs from the duct 14 as the duct 14' has turning vanes 82 staggered from top to bottom, positioned deeper from the inside face of the duct 14' from top to bottom, so as to turn the downward flowing stream 22 to be a horizontal flowing stream, out of the nozzles 64, 66. The staggering of the vanes 82 deeper from the nozzles from top to bottom of the duct 14' can help even out the flow from top to bottom of the duct 14'.

Thereby, an air stream 24 is created that is relatively thin, laminar and fast-moving at the exit of the nozzle portions 64 and 66, and is directed toward one side of the doorway on the upper portion and toward the other side of the doorway at the lower portion. As the air stream 24 traverses the doorway, from the duct 14 to the duct 16, its thickness expands, due to the friction and resistance that the air stream 24 is subjected to by the ambient air. By the time the air curtain 24 reaches the intake 34, its thickness approximates the thickness of the intake opening 34. In addition, the air curtain 24 may be overall aimed slightly more toward the warm side of the intake 34, as it is undesirable to draw warm air into the intake 34 since it carries excess moisture. This can be the case while still pointing the upper portion of the air stream 24 toward the warm side and the lower portion of the air stream 24 toward the cold side in relation to the direction of the upper portion of the air stream 24. In any event, the area of the intake 34 is significantly greater than the area of the apertures 42*a-c* and 44*a-c* that are the return air apertures in the wall 38. Therefore, not all of the air curtain 24, as it impinges on the intake plane 34, will be drawn into the duct 14, and that which will be drawn into the duct 14 is concentrated with air that exited the duct 14 through the nozzles 64 and 66, as is desired.

For example, with a doorway width of 8 feet and a nozzle 64, 66 width of about 1 inch, and a static pressure in the supply air duct 14 of about 1 to 1.25 inches of water, the air curtain remains relatively laminar and expands to only about 12-18 inches in width by the time it reaches a distance of about 18 inches to 24 inches from the intake opening 34 of the return air duct 16. Turbulence occurs at this distance from the duct 16 because of air impinging on the duct 16 and mixing with the ambient air to the sides of the doorway. Controlled suction is created in the collector chamber 36 by the apertures 42*a-c* and 44*a-c* to draw this zone of turbulence into the return air duct 16 so as to minimize the mixing of the air curtain 24 with the ambient air that is to the sides of the doorway. In this manner, the overall efficiency of the doorway 10 is maximized.

Illustrative embodiments of the invention have been described in detail for the purpose of disclosing a practical, operative structure whereby the invention may be practiced advantageously. However, the apparatus described is intended to be illustrative only, and the novel characteristics of the invention may be incorporated in other structural forms without departing from the scope of the invention. For example, additional air movers, heaters and/or diverters and/or hot gas refrigerant coils to reclaim heat extracted from the refrigeration process rather than or in addition to electric heaters may be employed, depending upon the conditions in a given application. The doorway assembly 10 may also be adapted to include a physical barrier, such as panel or strip doors.

Accordingly, to apprise the public of the full scope of the invention, the following claims are made:

A preferred embodiment of the invention has been described in considerable detail. Many modifications and variations to the preferred embodiment described will be apparent to a person of ordinary skill in the art. Therefore, the invention should not be limited to the embodiment described.

We claim:

1. In an air curtain doorway for forming an air curtain across a doorway between a relatively low temperature area and a relatively high temperature area, comprising duct work including a supply air duct at a first side of the doorway, said supply air duct having a supply air outlet aperture extending substantially the height of the first side, a return air duct at a second side of the doorway opposite from the first side and having a return air inlet aperture extending substantially the height of the second side, an intermediate air duct extending between the supply and return air ducts, and an air mover for moving an air stream through the duct work from the return air inlet aperture to the supply air outlet aperture, and out of the ductwork through the supply air outlet aperture so as to form an air curtain flowing from the supply air outlet aperture toward the return air inlet aperture, and to draw air into the ductwork through the return air inlet aperture, the improvement wherein:

the return air duct has a collector chamber upstream of the return air inlet aperture, and wherein the return air inlet aperture is adjustable in area.

2. The improvement of claim 1, wherein the collector chamber extends for substantially the height of the return air inlet aperture and has an inlet at an inside end facing toward the supply air outlet aperture, that is at least twice as wide as the total width of the return air inlet aperture.

3. The improvement of claim 1, further comprising a heater within the duct work for adding heat to the air flowing therein.

4. The improvement of claim 1, further comprising a nozzle downstream from the supply air outlet aperture that extends for substantially the height of the supply air outlet aperture.

5. The improvement of claim 1, wherein upper and lower portions of the air streams are directed in different directions.

6. The improvement of claim 1, wherein the air stream is directed toward one side of the doorway in the upper portion of the doorway and is directed to the other side of the doorway in the lower portion of the doorway.

7. The improvement of claim 1, further comprising a nozzle downstream from the supply air outlet aperture that extends for substantially the height of the supply air outlet aperture, wherein the supply air outlet aperture is at the inlet of the nozzle.

8. The improvement of claim 1, wherein the nozzle has an upper portion and a lower portion, and the upper portion directs the air curtain in a different direction than the lower portion.

9. The improvement of claim 8, wherein the upper portion of the nozzle directs air toward one side of the doorway and the lower portion of the nozzle directs air toward the other side of the doorway.

10. The improvement of claim 9, wherein the one side of the doorway is a side of the doorway toward a warmer space and the other side of the doorway is a side of the doorway toward a colder space.

11. The improvement of claim 1, further comprising a nozzle downstream from the supply air outlet aperture that extends for substantially the height of the supply air outlet aperture, wherein the supply air aperture is at the inlet of the nozzle.

12. In an air curtain doorway for forming an air curtain across a doorway between a relatively low temperature area and a relatively high temperature area, comprising duct work including a supply air duct at a first side of the doorway, said supply air duct having a supply air outlet aperture extending substantially the height of the first side, a return air duct at a second side of the doorway opposite from the first side and having a return air inlet aperture extending substantially the height of the second side, an intermediate air duct extending between the supply and return air ducts, and an air mover for moving an air stream through the duct work from the return air inlet aperture to the supply air outlet aperture, and out of the ductwork through the supply air outlet aperture so as to form an air curtain flowing from the supply air outlet aperture toward the return air inlet aperture, and to draw air into the ductwork through the return air inlet aperture, the improvement wherein:

the return air duct has a collector chamber upstream of the return air inlet aperture; and further comprising an air mover that creates a static pressure of at least one inch of water on an upstream side of the air mover.

13. In an air curtain doorway for forming an air curtain across a doorway between a relatively low temperature area and a relatively high temperature area, comprising duct work including a supply air duct at a first side of the doorway, said supply air duct having a supply air outlet aperture extending substantially the height of the first side, a return air duct at a second side of the doorway opposite from the first side and having a return air inlet aperture extending substantially the height of the second side, an intermediate air duct extending between the supply and return air ducts, and an air mover for moving an air stream through the duct work from the return air inlet aperture to the supply air outlet aperture, and out of the duct work through the supply air outlet aperture so as to form an air curtain flowing from the supply air outlet aperture toward the return air inlet aperture, and to draw air into the ductwork through the return air inlet aperture, the improvement wherein:

the return air inlet aperture is adjustable in area.

14. The improvement of claim 13, wherein the return air inlet aperture is spaced downstream from an intake opening of the return air duct.

15. In an air curtain doorway for forming an air curtain across a doorway between a relatively low temperature area and a relatively high temperature area, comprising duct work including a supply air duct at a first side of the doorway, said supply air duct having a supply air outlet aperture extending substantially the height of the first side, a return air duct at a second side of the doorway opposite from the first side and having a return air inlet aperture extending substantially the height of the second side, an intermediate air duct extending between the supply and return air ducts, and an air mover for moving an air stream through the duct work from the return air inlet aperture to the supply air outlet aperture, and out of the duct work through the supply air outlet aperture so as to form an air curtain flowing from the supply air outlet aperture toward the return air inlet aperture, and to draw air into the ductwork through the return air inlet aperture, the improvement wherein:

the return air inlet aperture is comprised of upper return air apertures and lower return air apertures, each of said upper return air apertures and said lower return air apertures being separately adjustable in area.

* * * * *